US007891900B2

(12) United States Patent
Clarke

(10) Patent No.: US 7,891,900 B2
(45) Date of Patent: Feb. 22, 2011

(54) STAIN AND SEALANT APPLICATOR

(76) Inventor: Michael T. Clarke, P.O. Box 289, Lowell, MI (US) 49331-0289

( * ) Notice: Subject to any disclaimer, the term of this patent is extended or adjusted under 35 U.S.C. 154(b) by 958 days.

(21) Appl. No.: 11/745,365

(22) Filed: May 7, 2007

(65) Prior Publication Data

US 2007/0269254 A1 Nov. 22, 2007

Related U.S. Application Data

(60) Provisional application No. 60/798,116, filed on May 5, 2006.

(51) Int. Cl.
*A46B 11/06* (2006.01)

(52) U.S. Cl. ..... 401/289; 401/268; 401/282

(58) Field of Classification Search ..... 401/136, 401/140, 268, 270, 278, 282, 285, 288, 289
See application file for complete search history.

(56) References Cited

U.S. PATENT DOCUMENTS

| | | | | |
|---|---|---|---|---|
| 864,953 | A | | 9/1907 | Craig |
| 3,020,579 | A | | 2/1962 | O'Connor |
| 3,503,691 | A | | 3/1970 | Kirch |
| 4,119,386 | A | * | 10/1978 | Cushing ..... 401/138 |
| 4,140,410 | A | | 2/1979 | Garcia |
| 4,152,084 | A | * | 5/1979 | Melton et al. ..... 401/188 R |
| 4,806,037 | A | | 2/1989 | Berglund |
| 4,971,471 | A | | 11/1990 | Sloan |
| 5,364,198 | A | | 11/1994 | Skenderi |
| 5,454,656 | A | | 10/1995 | Rowe |
| 5,595,451 | A | | 1/1997 | Harrison, Jr. |

* cited by examiner

*Primary Examiner*—David J Walczak
(74) *Attorney, Agent, or Firm*—Waters & Associates; John A. Waters

(57) ABSTRACT

An applicator system comprises a reservoir, a conduit extending from a first end at the reservoir to an opposite terminal end, an applicator connected with the conduit, a flow control engaging the conduit, and a holder releasably coupling with the applicator. The applicator has a liquid impermeable back, an opposite porous face, and a plenum. The plenum, situated between the back and face, releasably couples with the conduit terminal end and distributes fluid to the face. The face and plenum may be replaceable and disposable. The holder is a rigid member that releasably couples with the applicator, provides a structural foundation to the applicator, and includes a handle for manipulation by a user. An extension can be employed to connect the flow control to the handle, effectively extending the length of the handle. A helical coil portion of the conduit can be conveniently wrapped around the extension to prevent kinking.

15 Claims, 8 Drawing Sheets

STAIN AND SEALANT APPLICATOR

CROSS-REFERENCE TO RELATED APPLICATIONS

This application is based on and claims the benefit of the filing date of Applicant's provisional patent application No. 60/798,116, filed May 5, 2006, the disclosure of which is incorporated herein by reference.

BACKGROUND OF THE INVENTION

The invention relates to the application of finishes. More specifically, the invention is directed to fluid finish application from a finish reservoir, including a hose or tube to dispense finish from the reservoir to an applicator.

A variety of painting or finish applicator systems may be found in the market, on the shelves of home centers and hardware stores. The prior systems are known to draw or press a fluid finish from a can, bucket, or other reservoir and through a hose to an applicator in the form of a brush, a roller, or a pad. The reservoir may be an open container and a pump may be used to draw or suck a finish from the container. Alternatively, the reservoir may be a pressurized vessel from which a finish is pressed out with air pressure.

A pressurized fluid reservoir is commonly known and configured as a lawn and garden sprayer, for example, and includes a liquid-dispensing tank or reservoir that is connected, by means of a length of flexible hose, to a spray wand. The dispensing tank also includes a means for pressurizing its liquid contents, typically a hand-operated air pump assembly. Common prior pressurized tanks include a dip tube that extends to the bottom of the tank. The fluid contents of the tank are pressed through the dip tube and out of the tank when the tank is pressurized by air pressure. The flexible hose is commonly connected with the dip tube direct the fluid from the tank and to an applicator as desired. Various methods are used to make the connection between the flexible hose and the dip tube, including various hose clamps and alternatively, various compression screw fittings.

Unfortunately, prior methods of connecting the flexible hose with the dip tube include some problems. The prior connection methods are expensive to assemble for the manufacturer and ultimately the customer. The prior connections are also subject to failure, including fluid leakage. As a person uses a pressure tank, the dispensing hose is pulled, bent, and twisted at the connection with the dip tube. This tugging tends to pull the dispensing hose away from the dip tube, even in the presence of a metal band hose clamp and the like. The problem increases with increased use and with rough handling; lack of care. Other than the dispensing hose being damaged, the top of the dip tube, where the dispensing hose connects, may break or otherwise fail.

When the finish flows through the hose from the reservoir to the applicator, the finish is ultimately transferred to a surface by a surface contacting device. The applicator typically includes an applicator head with a handle and some surface contacting device, which may include a brush, a roller, a pad, or the like. A typical path of delivering the finish is to include the applicator head, so the fluid finish flows through the head from the hose and to the surface contacting device. Thus, the finish must contact the applicator head and, in fact, accumulates inside the head. This results in the applicator head being one more item of equipment that the user must clean. One will not typically dispose of the applicator head instead of cleaning it because the head is not a "throw away" item.

Further, the path of the fluid finish through the applicator head may include large passageways in which the finish may collect as in small reservoirs within the applicator head. The common use of a finish path that passes through the head, including its reservoirs, wastes finish and increases the mess of cleaning. This is not merely an obvious inconvenience and expense, it is also an unnecessary environmental burden.

Thus, a need to improve stain and sealant applicator systems is readily understood.

BRIEF SUMMARY OF THE INVENTION

Accordingly, a stain and sealant applicator system of the invention includes a reservoir that is adapted to contain a fluid finish, a conduit that is adapted to conduct a fluid finish from the reservoir, an applicator that is adapted to dispose a fluid finish upon a surface, a flow control that is adapted to control flow of a fluid finish through the conduit, and a holder that is a rigid member that is adapted to releasably couple with the applicator.

In various aspects of the invention, the conduit may extend from a first end at the reservoir to an opposite terminal end at the applicator. The applicator may have a back that is liquid impermeable and an opposite face that is porous. A plenum may be formed in the applicator and be adapted to distribute a fluid finish to the face. The plenum may further include a coupler that releasably couples with the conduit terminal end in liquid tight engagement. The flow control may engage the conduit to regulate a flow of a fluid finish through the conduit. Further, the holder may provide structural foundation to the applicator and may include a handle that is adapted to be grasped and manipulated by a user.

In other aspects of the invention, the applicator may be fabricated with the back defining a base portion as a liquid impermeable structural substrate that has opposing front and back surfaces and has a circumscribing perimeter edge that extends between the opposing front and back surfaces. The base substrate may further be adapted to releasably couple at the back surface with the holder, so a user may manipulate the applicator with the holder. Thus, the front surface faces away from the holder. The applicator may also be fabricated with an application face portion defined over the front surface of the base substrate. The application face portion may be configured as a liquid permeable layer of the applicator, so the application face extends from the front surface and extends in a direction away from the back surface. The applicator may further be fabricated with a plenum portion that distributes a fluid finish to the application face. The plenum may be connected with the application face at the base front surface. The plenum may include a coupler that releasably couples with the conduit terminal end in liquid tight engagement. Thus, a fluid finish may be dispensed from the reservoir, through the conduit, into the applicator at the base front surface, and distributed about the application face.

In another aspect of the invention, the reservoir may be provided with an annular stem that defines a passageway through the annular wall. The conduit may be provided with a one piece tubular member that extends from a first end within the reservoir, through the annular stem, and to an opposite second end. The conduit may further be provided with a cap that couples with the annular stem and secures the conduit relative to the reservoir.

In yet other aspects of the invention, the flow control may have an elongated body with opposite upstream and downstream ends. A valve may be located in the body and may further include an actuator, so the valve may be manipulated between open and closed conditions by a user. A stain and sealant applicator system of the invention may also include an optional extension that releasably couples with the handle and optionally effectively extends the handle. The extension may be an elongated member with opposite first and second ends. The first end may be adapted to releasably couple with the handle. The second end of the extension may include a recess that corresponds with the elongated body of the flow control, so the flow control releasably couples with the extension.

These and other features, objectives, and benefits of the invention will be recognized by one having ordinary skill in the art and by those who practice the invention, from this disclosure, including the specification, the claims, and the drawing figures.

DETAILED DESCRIPTION

Figure 2:
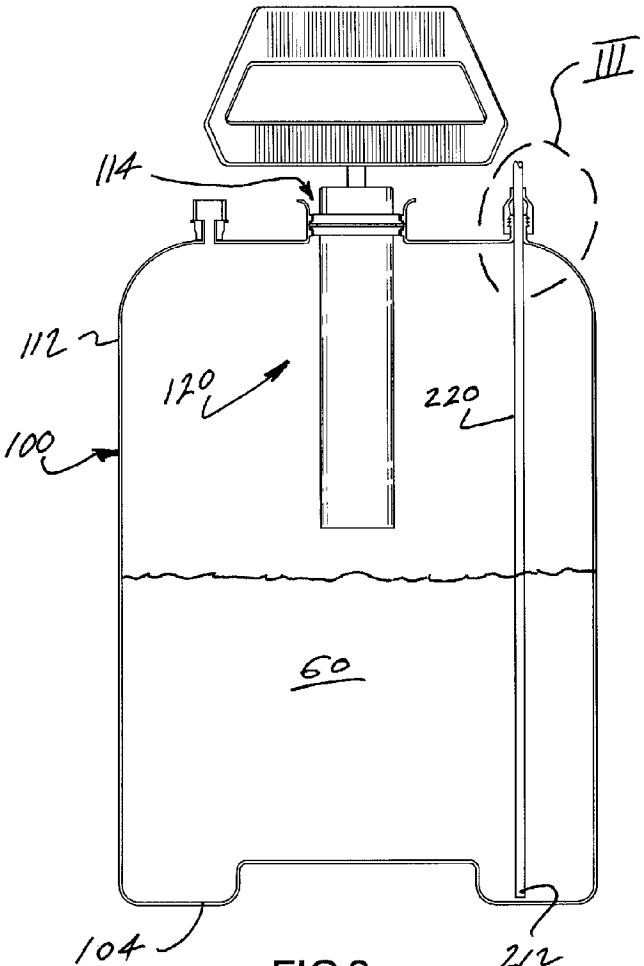
FIG. 2 is a cross section view, partially in elevation, of a reservoir thereof.

A preferred and exemplary embodiment of a stain and sealant applicator system 50 according to the invention is generally shown in the drawing figures and discussed below. The applicator system is directed to the application of a stain or sealant and the like to a floor, deck, or other generally planar surface. The applicator system includes a reservoir 100, a conduit 200, an applicator 300, a flow control 400, and a holder 500. An extension 600 may optionally be used between the flow control and the holder.

Figure 1:
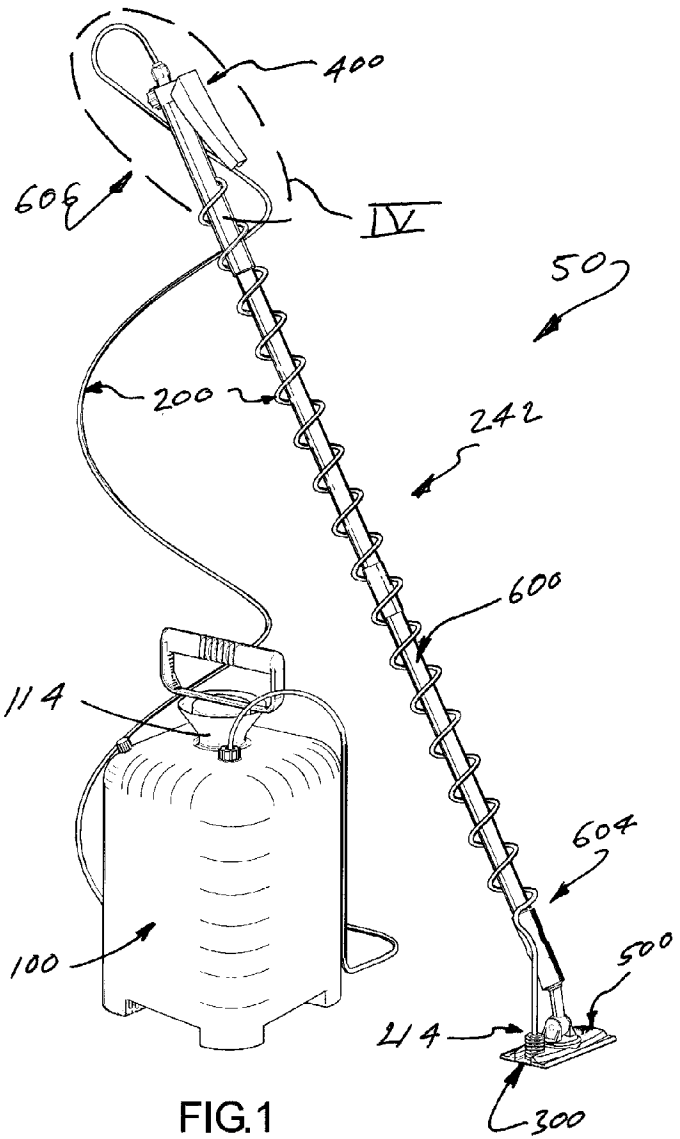
FIG. 1 is a perspective view of an exemplary stain and sealant applicator system according to the invention.
Figure 3:
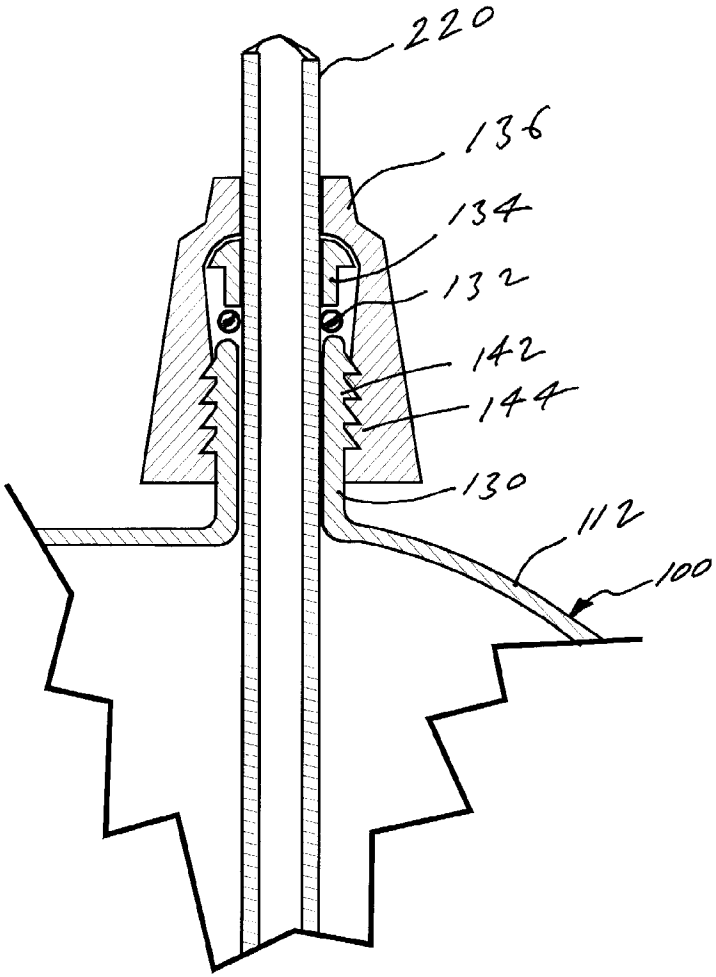
FIG. 3 is an enlarged view of detail III of FIG. 2.
Figure 6:
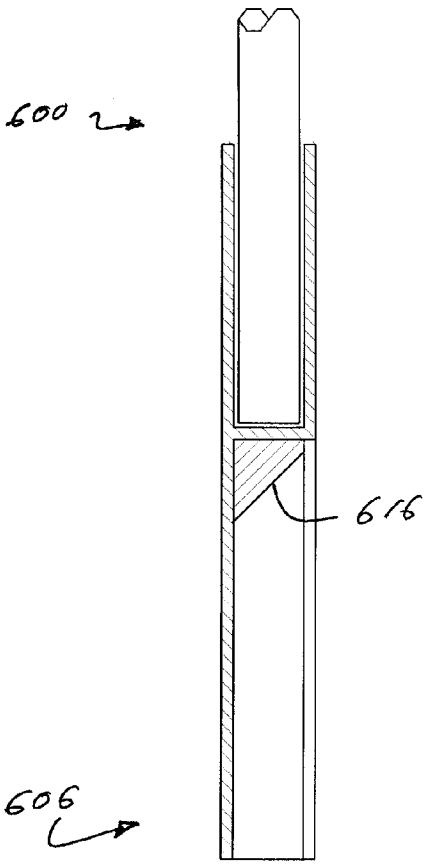
FIG. 6 is a lengthwise cross section view of an extension pole end that couples with the flow control.

A fluid finish 60 is placed in the reservoir 100 for dispensing through the applicator system 50 to a selected surface (not shown and commonly known). The reservoir 100 may preferably be provided as a pressure tank as is commonly known for lawn and garden sprayer tanks (FIGS. 1-3). A perimeter sidewall 112 generally defines the tank, which may be fabricated of any suitable engineering material for a low pressure tank and by any method that is suitable to the selected material. The tank is provided with a fill mouth 114 through which fluids are received in the tank. A pressurizing device 120, such as a hand operated air pump, may be used to pressurize the tank and to form a stopper for the tank by screw thread engagement of the stopper with the mouth, as is commonly known to one having ordinary skill in the art and by those who use lawn and garden sprayer tanks.

The conduit 200 extends from a first end 212 at a bottom 104 of the tank 100 and through the perimeter wall 112 to a terminal end 214 at the applicator 300 to dispense fluid contained or placed in the tank. Thus, the tank perimeter wall is provided with an annular stem 130 through which the fluid may be dispensed from the tank by way of the conduit, which conduit may also be considered a dispensing tube or hose 200. The conduit may be fabricated as is suitable for a dispensing hose and may result in a typical size of about 9/32 inch (7.14 mm) outside diameter.

A distinction of the present tank 100 and its conduit or hose configuration 200 is that the conduit includes a one piece tubular member 220 that extends from the first end 212 within the reservoir 100, through the annular stem 130, and to an opposite second end. This is in contrast to commonly known pressure tank arrangements in which a separate dip tube and a separate dispensing tube are used with a joint or connection outside the tank between the two pieces of tubing or hose. More specifically, prior pressure tank arrangements commonly have a dip tube extending inside the tank to the tank bottom. A separate dispensing tube or hose then couples with the dip tube at a location outside the tank. The prior dip tube tends to be a relatively more rigid member and the dispensing hose relatively more pliable. Thus, the prior arrangement with separate dip and dispensing tubes is prone to fatigue and failure near their interface, with associated fluid leakage.

Further as to the present dispensing tube 200 of the invention, the one piece tubular member 220 is circumscribed by a sealing O-ring 132 as one having ordinary skill in the art understands, and a compression grommet 134 (FIG. 3). An appropriate grommet may include a Heyco® Shorty Bushing, B 406-281, for cooperating with a dispensing hose having an about 9/32 inch (7.14 mm) outside diameter, for example.

When assembled (FIG. 3), the one piece tubular member 220 extends through the annular stem 130, from the first end 212 near the tank bottom 104. The O-ring 132 is located outside the tank 100 and abuts the tubular stem 130. The grommet 134 is positioned opposite the O-ring from the tubular stem. A compression nut 136 or other similarly functioning device overlays the grommet and O-ring and couples with the annular stem. Thus, the annular stem may be provided with external threads 142 that cooperate with internal threads 144 of the compression nut 136. While threaded engagement of the compression nut with the annular stem provides for removal, that is disassembly and reassembly, alternative compression nut devices may include a press-on nut device that is not intended to disengage the stem.

Figure 4:
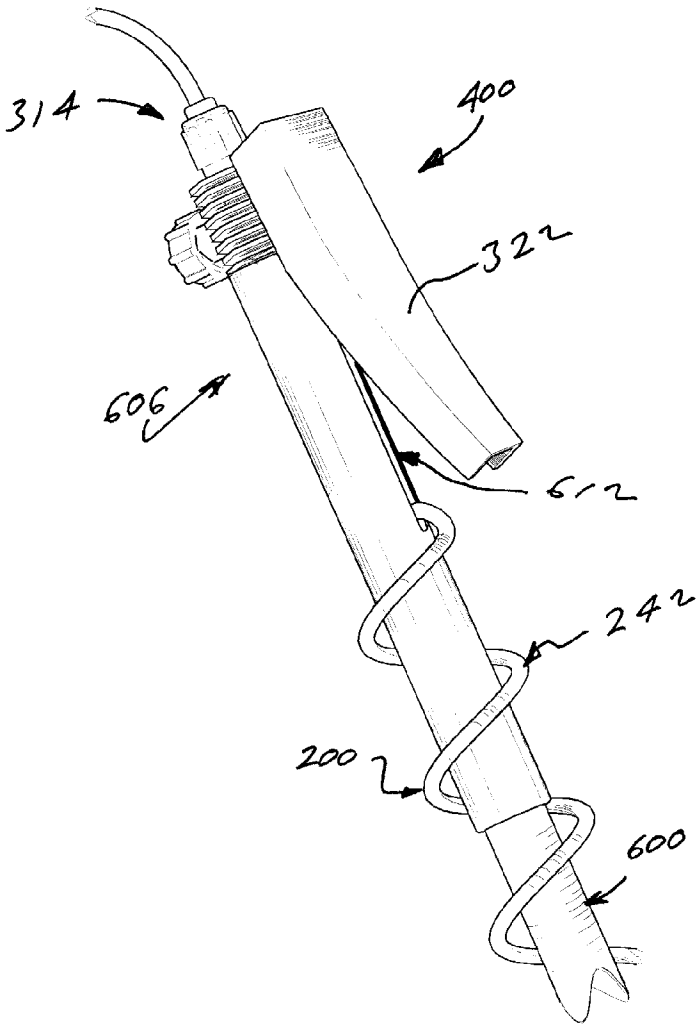
FIG. 4 is an enlarged view of detail IV of FIG. 1.
Figure 5:
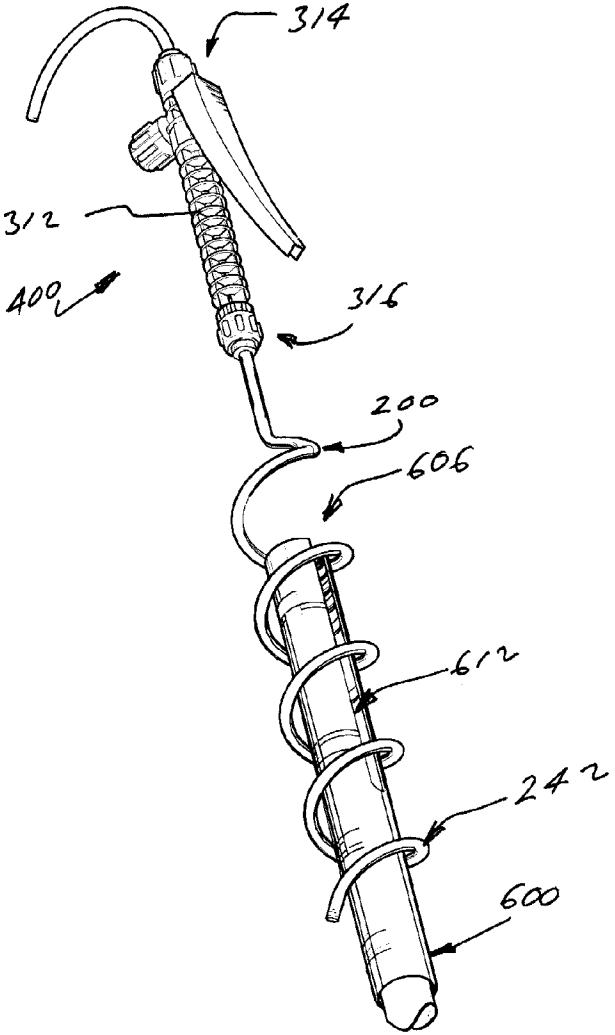
FIG. 5 is the view of FIG. 4 showing a flow control separated from an extension.
Figure 8:
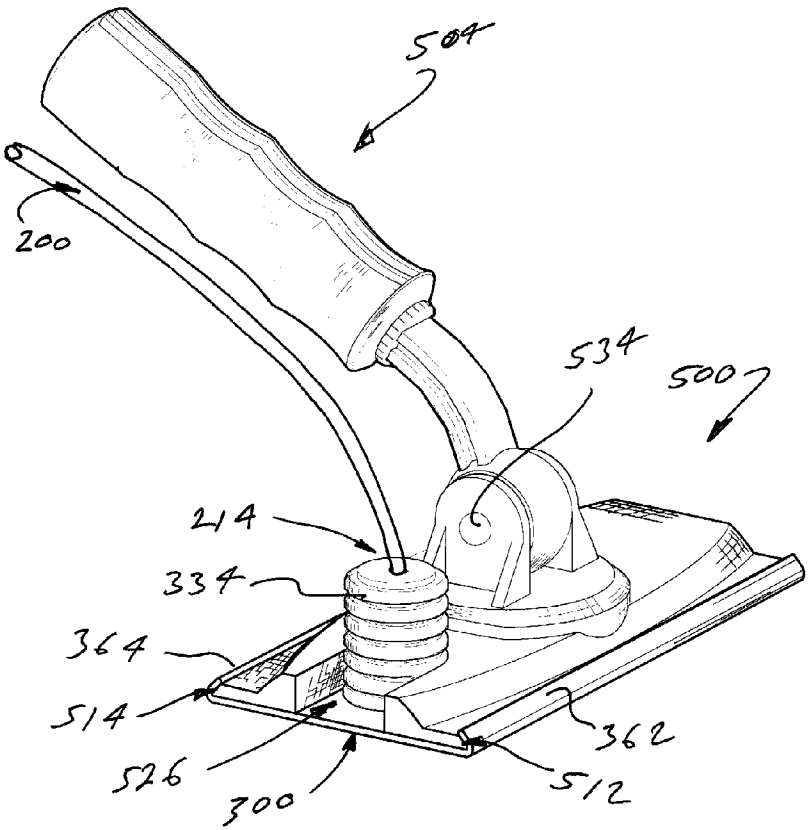
FIG. 8 is a perspective view of head assembly of the finish applicator system of FIG. 1, showing an applicator, a foundation, and a handle thereof.
Figure 7:
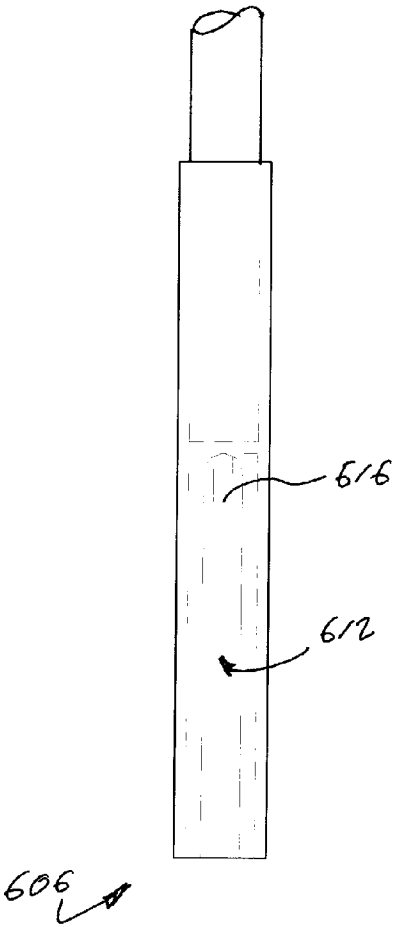
FIG. 7 is a top plan view thereof.
Figure 10:
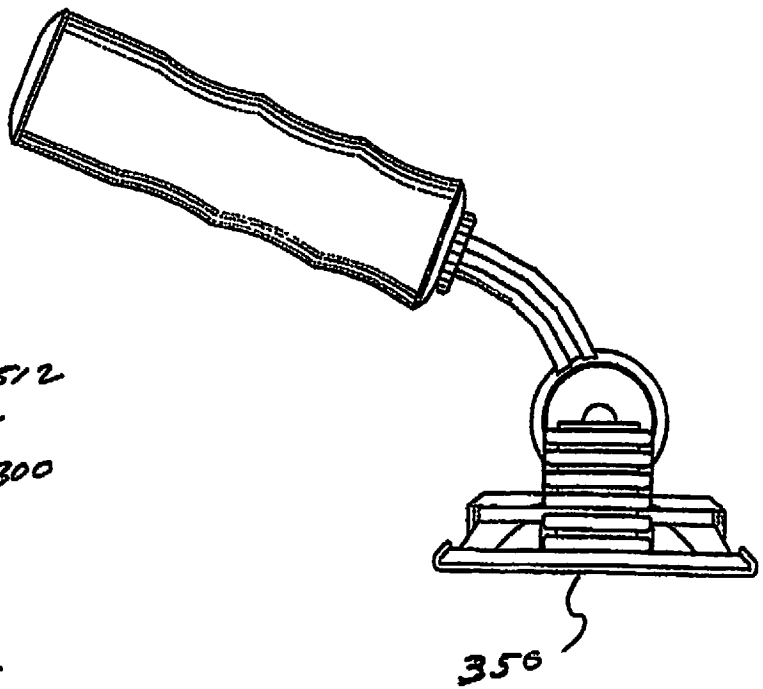
FIG. 10 is a right side elevation of the head assembly of FIG. 8.
Figure 9:
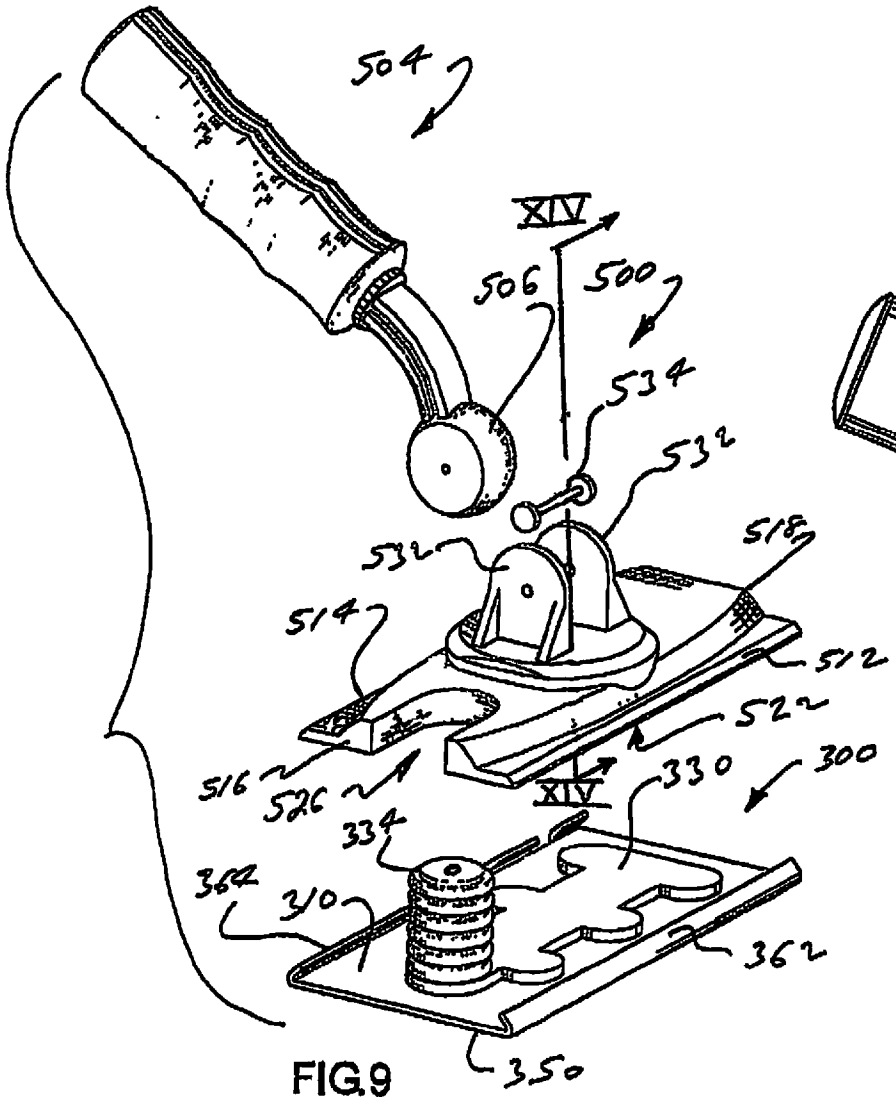
FIG. 9 is an exploded view of the head assembly of FIG. 8, showing the applicator, foundation, and handle thereof separated.
Figure 12:
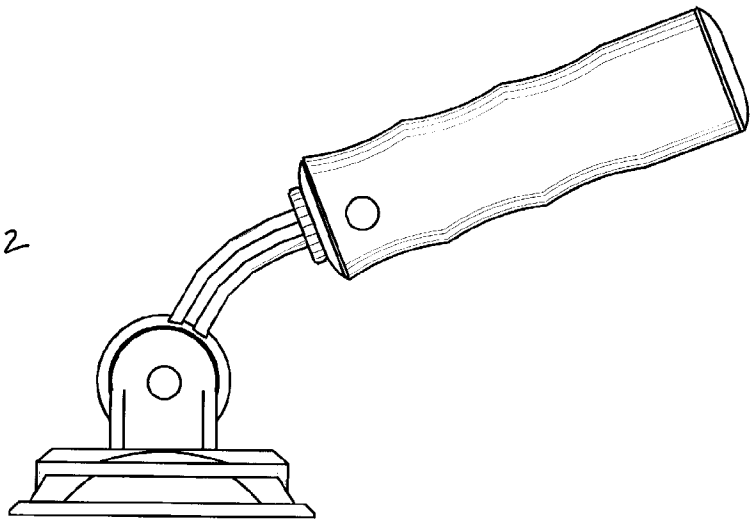
FIG. 12 is a left side elevation of the head assembly of FIG. 8.
Figure 11:
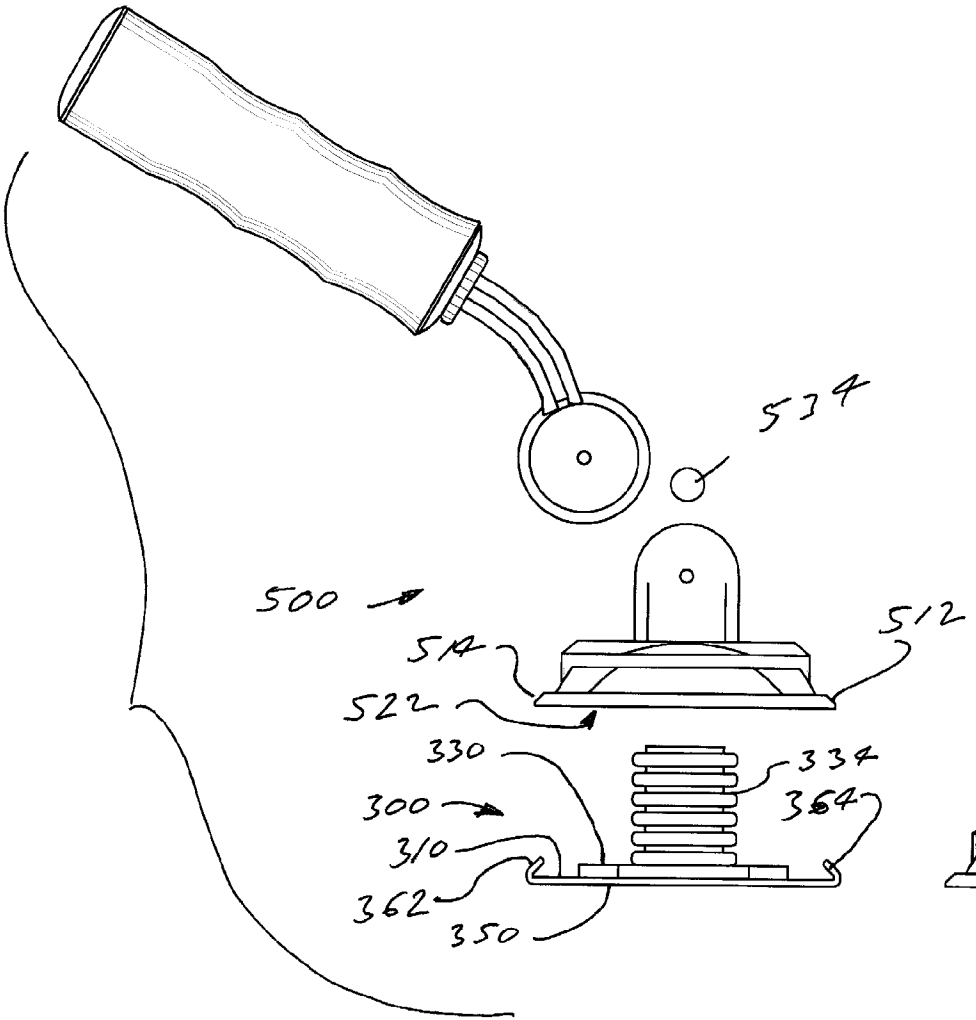
FIG. 11 is an exploded view of the head assembly of FIG. 10.
Figure 14:
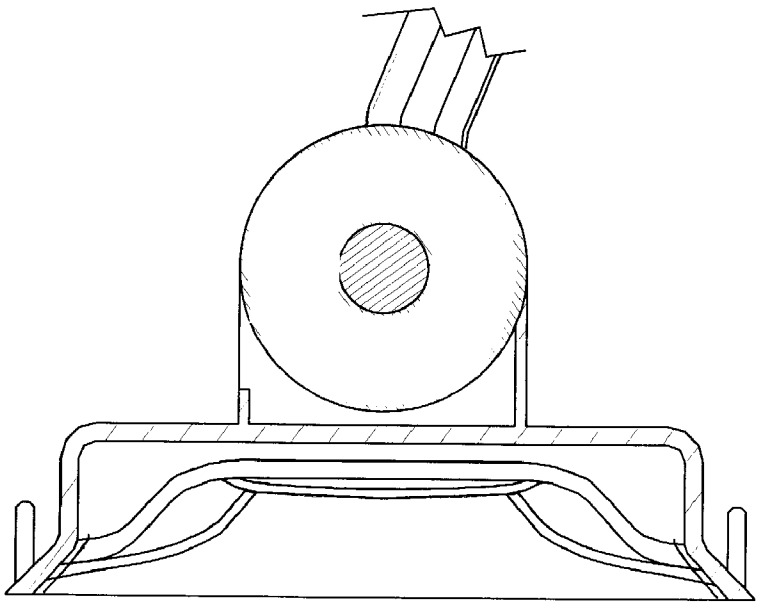
FIG. 14 is a cross section view of the foundation along sight line XIV-XIV of FIG. 9.
Figure 13:
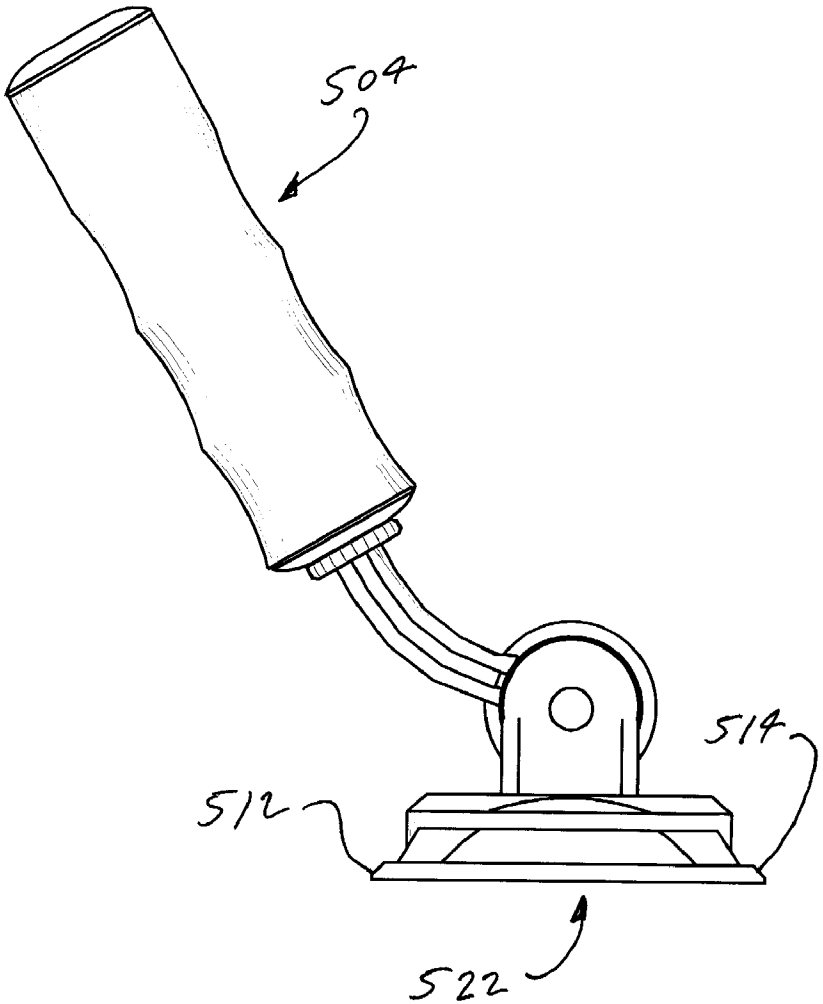
FIG. 13 is the view of FIG. 12, showing the handle pivoted over to the other side of the foundation.
Figure 16:
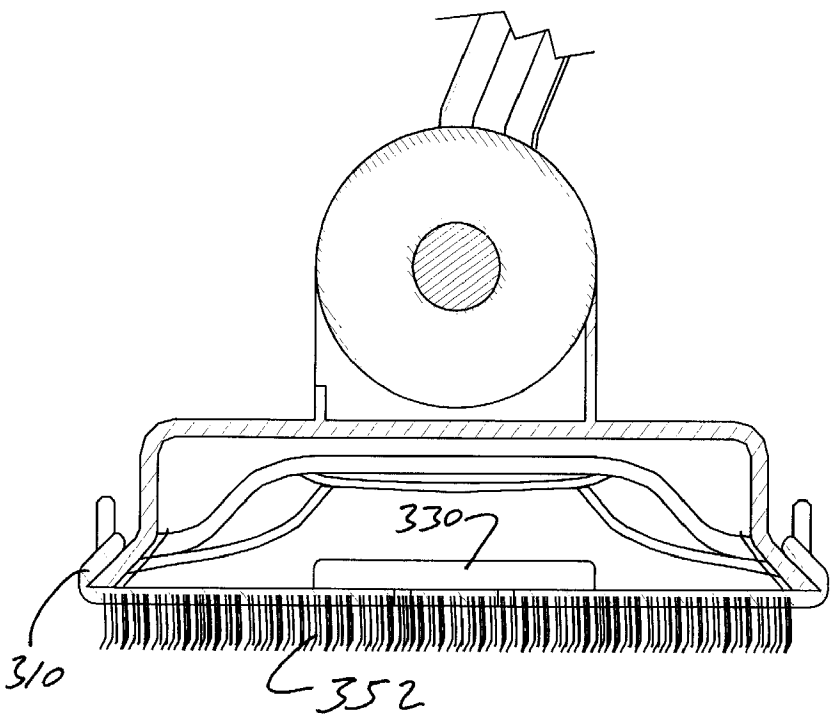
FIG. 16 is the cross section view of FIG. 14, showing an alternative bristle brush applicator mounted on the foundation.
Figure 15:
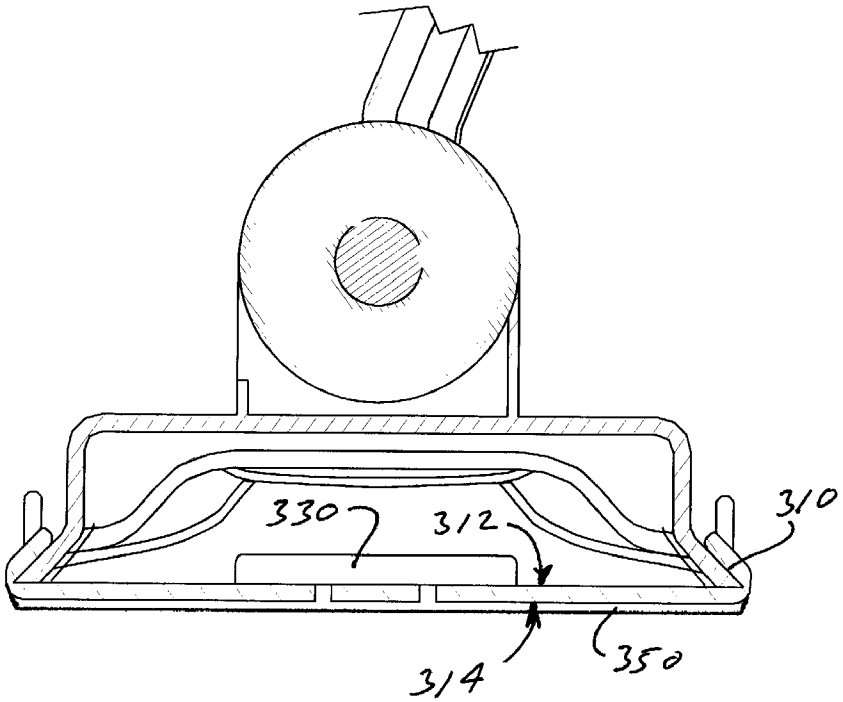
FIG. 15 is the cross section view of FIG. 14, showing the applicator mounted on the foundation.

The one piece tubular member 220 extends from the reservoir 100 to the flow control 400, which allows a user to open and close and otherwise control a flow of fluid finish 60 from the reservoir 100 through the dispensing hose 200 to the applicator 300. Known flow control or valve mechanisms may be used. The flow control 400 may have an elongated body 312, preferably a generally tubular member with opposite upstream 314 and downstream 316 ends, for comfort and ease of use (FIGS. 4 and 5). A valve (not shown and commonly known) is located in the body and may be positioned near the upstream end, as shown. An actuator 322 in the form of a control lever is connected with the valve. Thus, a user may manipulate the actuator, control the valve between open and close conditions, and regulate fluid flow through the dispensing hose 200.

The dispensing tube 200 continues from the downstream end of the flow control, as shown, and directly to the applicator 300. The applicator has a base portion 310, a plenum portion 330, and an application face portion 350 (FIGS. 8-16). The base portion 310 is a liquid impermeable structural substrate. The base has opposing back and front surfaces, 312 and 314 respectively, and a circumscribing perimeter edge that extends between the front and back surfaces. The application face 350 may be a liquid permeable layer that is defined over the front surface of the base portion 310, so the application face extends from the front surface and extends in a direction away from the back surface of the base portion. The application face is a liquid permeable layer and may be configured in a number of formations, including a surface engaging pad or bristle brush 352. The applicator 300 is preferably fabricated as a multi-strata unitary molding.

The plenum portion 330 of the applicator is most preferably connected in fluid communication with the application face 350 through openings leading to the front surface 314 of the base portion 310 and distributes the fluid finish 60 to the application face at the base front surface. The plenum also includes a coupler 334 that releasably couples with the dispensing hose terminal end 214 in liquid tight engagement. This arrangement of the dispensing hose 200 connecting directly with the applicator 300 does not involve the holder 500 and keeps the holder clean of unnecessary contamination with the finish 60, in contrast to configuration of prior finish application devices in which a unified head arrangement conducts the finish through the holder to reach a surface engaging pad and the like.

The holder 500 of the present invention is a rigid member that releasably couples with the applicator 300 and provides a structural foundation for the applicator (FIGS. 8-16). The holder also has a generally tubular handle 504 for grasping and manipulation by a user. While the holder may be fabricated with various configurations, the exemplary preferred embodiment is shown with a generally rectangular footprint, with a first pair of opposing side edges 512 and 514, and a pair of orthogonal opposing end edges 516 and 518. A face 522 of the holder is defined as a generally planer surface that extends between the opposing side edges and the opposing end edges. The side edges are provided with a champher or taper back away from the holder face 522. These tapered side edges 512 and 514 cooperate with the applicator for releasable coupling of the applicator with the holder. Thus, the applicator is further provided with a pair of corresponding flanges 362 and 364 that extend over and around the holder tapered side edges 512 and 514, when the holder 500 and applicator 300 are coupled.

A recess 526 is preferably defined in at least one end 516 of the holder 500 to accommodate and provide clearance for the hose coupler 334 of the applicator 300. Assembly of the holder with the applicator is then by sliding the applicator over the holder face 522 from the notched end 516 of the holder until the applicator and the holder align, with the hose coupler 334 located in the end notch 526 of the holder.

The handle 504 is preferably pivotally connected with the holder 500. A pair of pivot flanges 532 extend from a back of the holder and away from the holder face 522. The handle has a cooperating end 506 that nests between the pivot flanges 532. The handle and the pivot flanges are secured by a pivot pin 534.

The extension 600 may be provided as a pole and used between the flow control 400 and the handle 504 of the holder 500 and optionally effectively extend the handle. Thus, the extension is an elongated member with opposite first and second ends, 604 and 606 respectively. The first end 604 is adapted to releasably couple with the handle 504 and the second end 606 is adapted to releasable couple with the flow control 400. A preferred interface between the extension and the handle is by screw threading the extension into the handle as is commonly known in the broom handle and painting roller areas of technology. The second end 606 of the handle is provided as a tubular portion with a lengthwise slot 612. The tubular portion and lengthwise slot extend about as far as the flow control elongated body 312 is long. The flow control and extension are coupled by inserting the downstream end 316 of the flow control into the second end 606 of the extension with the dispensing hose 200 laying in and extending through the slot 612. Further, a sloped wall 616 or ramped portion may be provided in the tubular portion of the extension second end 606. The ramped wall may be positioned as a stop to position the flow control 400 by limiting placement of the flow control elongated body 312 into the extension second end and also to guide the dispensing hose without kinking.

A portion of the dispensing hose that extends from the downstream end 316 of the flow control 400 to the applicator 300 is most preferably provided as a helical coil hose. This helical coil configuration helps keep the dispensing hose organized in use. The helical coil portion 242 of the dispensing hose 200 may also conveniently corkscrew about the extension 600 by merely inserting the extension through the helical coil, then coupling the flow control in the second end 606 of the extension and coupling the extension first end 604 with the holder handle 504. Thus, the dispensing hose and the extension become a tidy assembly for convenient use. When assembled in this configuration, the extension may retract and extend without binding with the hose 200, while the hose is kept organized by the coiled portion 242. An expected common range of extension and retraction of the extension 600 is of the order of about 42 to 24 inches (1067-609 mm), although this is not a limitation of the invention.

One having ordinary skill in the art and those who practice the invention will understand from this disclosure that various modifications and improvements may be made without departing from the spirit of the disclosed inventive concept. One will also understand that various relational terms, including left, right, front, back, top, and bottom, for example, are used in the detailed description of the invention and in the claims only to convey relative positioning of various elements of the claimed invention.

What is claimed is:

1. A stain and sealant applicator system comprising:

a reservoir that is adapted to contain a fluid finish;

a flexible conduit that is adapted to conduct the fluid finish from the reservoir to an applicator, the conduit being operatively connected with the reservoir, and extending from a first end at the reservoir to an opposite terminal end;

an applicator that is adapted to dispense a fluid finish upon a surface, the applicator being operatively connected with the terminal end of the conduit, and having a base portion, a plenum portion on the base portion at a rear surface thereof, and an application face portion positioned on a front surface of the base portion and in fluid communication with the plenum portion, the base portion being of a liquid impermeable structural substrate, the face portion being of a liquid permeable material, the plenum portion having an inlet connectable in fluid communication with the terminal end of the conduit and being adapted to distribute the fluid finish to the face portion;

a flow control that is adapted to control flow of a fluid finish through the conduit and that operatively engages the conduit; and an applicator holder adapted to releasably couple with the applicator and provide a structural foundation to the applicator, the holder further including a handle adapted to be grasped and manipulated by a user, wherein the conduit comprises a one piece tubular member extending from a first end within the reservoir, through an annular stem on the reservoir, to an opposite second end.

2. A stain and sealant applicator system as in claim 1, and further including an extension releasably connectable between the flow control and the holder handle.

3. A stain and sealant applicator system as in claim 2, wherein the extension is a pole releasably connected at one end to the flow control and at the opposite end to the handle.

4. A stain and sealant applicator system as in claim 1, wherein the reservoir is a pressure tank.

5. A stain and sealant applicator system as in claim 1, further comprising a pressurizing device capable of pressurizing the reservoir, the pressurizing device coupling with the reservoir by screw thread engagement with a mouth of the reservoir.

6. A stain and sealant applicator system as in claim 1, wherein the conduit is circumscribed within the annular stem by a sealing O-ring and a compression grommet and coupled to the annular stem by means of a nut.

7. A stain and sealant applicator system as in claim 1, wherein the plenum portion includes a coupler that releasably couples with the terminal end of the conduit in liquid tight engagement.

8. A stain and sealant applicator system as in claim 7, wherein the holder is generally rectangular, having tapered side edges that cooperate with the applicator for releasably coupling the applicator with the holder, the applicator having flanges that extend over and around the tapered side edges of the holder, the holder further having a recess in one or both ends to accommodate and provide clearance for the plenum coupler.

9. A stain and sealant applicator system as in claim 1, wherein the application face portion is a surface engaging pad.

10. A stain and sealant applicator system as in claim 1, wherein the application face portion is a bristle brush.

11. A stain and sealant applicator system as in claim 1, wherein the handle is pivotally connected to the applicator holder.

12. A stain and sealant applicator system as in claim 1, wherein a portion of the conduit extending from the flow control to the applicator is a helical coil hose.

13. A stain and sealant applicator system comprising:

a reservoir that is adapted to contain a fluid finish;

a flexible conduit that is adapted to conduct the fluid finish from the reservoir to an applicator, the conduit being operatively connected with the reservoir, and extending from a first end at the reservoir to an opposite terminal end;

an applicator that is adapted to dispense a fluid finish upon a surface, the applicator being operatively connected with the terminal end of the conduit, and having a base portion, a plenum portion on the base portion at a rear surface thereof, and an application face portion positioned on a front surface of the base portion and in fluid communication with the plenum portion, the base portion being of a liquid impermeable structural substrate, the face portion being of a liquid permeable material, the plenum portion having an inlet connectable in fluid communication with the terminal end of the conduit and being adapted to distribute the fluid finish to the face portion;

a flow control that is adapted to control flow of a fluid finish through the conduit and that operatively engages the conduit; and an applicator holder adapted to releasably couple with the applicator and provide a structural foundation to the applicator, the holder further including a handle adapted to be grasped and manipulated by a user, and further including an extension releasably connectable between the flow control and the holder handle, the extension being a pole releasably connected at one end to the flow control and at the opposite end to the handle, wherein a portion of the conduit extending from the flow control to the applicator is a helical coil hose capable of wrapping around the extension in corkscrew fashion, finally entering a plenum coupler.

14. A stain and sealant applicator system comprising:

a reservoir that is adapted to contain a fluid finish;

a flexible conduit that is adapted to conduct the fluid finish from the reservoir to an applicator, the conduit being operatively connected with the reservoir, and extending from a first end at the reservoir to an opposite terminal end;

an applicator that is adapted to dispense a fluid finish upon a surface, the applicator being operatively connected with the terminal end of the conduit, and having a base portion, a plenum portion on the base portion at a rear surface thereof, and an application face portion positioned on a front surface of the base portion and in fluid communication with the plenum portion, the base portion being of a liquid impermeable structural substrate, the face portion being of a liquid permeable material, the plenum portion having an inlet connectable in fluid communication with the terminal end of the conduit and being adapted to distribute the fluid finish to the face portion;

a flow control that is adapted to control flow of a fluid finish through the conduit and that operatively engages the conduit; and an applicator holder adapted to releasably couple with the applicator and provide a structural foundation to the applicator, the holder further including a handle adapted to be grasped and manipulated by a user, wherein the flow control is releasably mounted in an opening in one end of an extension pole, with the pole having an open slot on one side of the opening for egress of the conduit from the opening, the extension pole having a sloped wall facing the slot at an inner end of the opening, the sloped wall serving to guide the conduit out of the slot without kinking.

15. A stain and sealant applicator system as in claim 14, wherein the extension pole is electively extendible between about 24 inches and about 42 inches.

* * * * *